US005511777A

United States Patent [19]

McNeely

[11] Patent Number: 5,511,777

[45] Date of Patent: Apr. 30, 1996

[54] BALL BAT WITH REBOUND CORE

[75] Inventor: Larry A. McNeely, Huntington Beach, Calif.

[73] Assignee: Grover Products Co., Los Angeles, Calif.

[21] Appl. No.: 191,300

[22] Filed: Feb. 3, 1994

[51] Int. Cl.[6] ..... A63B 59/06

[52] U.S. Cl. ..... 273/72 A; 273/72 R

[58] Field of Search ..... 273/72 A, 72 R, 273/26 B, 73, 80

[56] References Cited

U.S. PATENT DOCUMENTS

| | | | |
|---|---|---|---|
| 2,379,006 | 6/1945 | Johnson | 273/72 R |
| 3,727,295 | 4/1973 | Gildemeister . | |
| 3,801,098 | 4/1974 | Gildemeister . | |
| 3,811,596 | 5/1974 | Wilson | 273/72 A |
| 3,830,496 | 8/1974 | Reizer . | |
| 3,972,528 | 8/1976 | McCracken et al. . | |
| 4,351,786 | 9/1982 | Mueller | 273/72 R |
| 5,094,453 | 3/1992 | Douglas et al. | 273/72 R |
| 5,104,123 | 4/1992 | Okitsu et al. . | |
| 5,114,144 | 5/1992 | Baum | 273/26 B |
| 5,219,164 | 6/1993 | Peng . | |
| 5,393,055 | 2/1995 | MacKay, Jr. . | |
| 5,415,398 | 5/1995 | Eggiman . | |

FOREIGN PATENT DOCUMENTS

| | | |
|---|---|---|
| 4-303477 | 10/1992 | Japan . |
| 5-23407 | 2/1993 | Japan . |

*Primary Examiner*—Mark S. Graham

*Attorney, Agent, or Firm*—Paul Y. Feng; Poms, Smith, Lande & Rose

[57] ABSTRACT

A hollow, tube-shaped ball bat having a damping core made a tube of brass wrapped in a resilient sleeve made from polystyrene closed cell foam is disclosed. The damping core is forcibly inserted into the interior of the hollow bat by compressing the resilient sleeve. When assembled into the bat, the resilient sleeve is under great compression. Furthermore, the tubing wall forming the bat is relatively thin to transmit the impact of the ball to the resilient sleeve. The processes to obtain a damped core bat are also disclosed. A tube is provided which is swaged to form a barrel portion, a tapered portion, and a handle portion. The resilient sleeve is compressed and inserted into the open top of the tube. Alternatively, the damping core is inserted into the tube and the inner damper which has a tube structure is expanded radially to compress the resilient sleeve between it and the tube wall. The top of the tube is covered by a cap and the bottom of the tube is enclosed with a knob. The ball bat is made from a high tensile aluminum alloy or a high strength aircraft alloy.

15 Claims, 2 Drawing Sheets

BALL BAT WITH REBOUND CORE

BACKGROUND OF THE INVENTION

1. Field of the Invention

The present invention relates to ball bats. More precisely, the present invention relates to a ball bat having means to conserve the kinetic energy from a ball impact for a lively rebound, and to dampen the sound and vibration created by the impact.

2. Description of Related Art

A ball bat is most commonly found in the game of baseball, which dates back to the early 1800s. Baseball bats are usually made from a solid plank of lumber that is turned on a lathe to obtain the familiar baseball bat shape. The bat is sanded down to a smooth exterior finish and then sealed with varnish or similar type covering.

The game of baseball grew to be a national past-time. Meanwhile, the game also inspired variations of the sport, the most popular of which is softball. Little league ball, slow pitch softball, as well as T-ball became popular for younger players. The common thread throughout these sporting games is the ball and bat.

The bats used in these games varied widely in size, shape, weight, and construction. Furthermore, innovative individuals continually improved the performance of bats to give the player an edge over the competition.

For example, after the original wooden bat came the metal bat. Typically, the metal bat was made from an aluminum alloy and was hollow inside. The bats were made from a tube of aluminum, wherein a swaging machine formed the tube into a bat profile. The were three major sections of the bat: namely, the barrel portion, the tapered portion, and the handle portion. A cap covered the opening at the top end of the tube while a knob covered the bottom opening of the tube. The swaging operation was necessary to decrease the diameter of the handle portion to a dimension smaller than the diameter of the barrel portion to allow players to easily grip the bat.

Aside from aluminum alloys, magnesium, titanium, and even ceramics have been used to make bats. There are even composite bats made of carbon fiber embedded in silicon glass and laminated to form a precise shell.

For anyone who has swung a bat and hit a ball, he or she is very cognizant of the noise and vibration perceived at the instant of impact between the bat and ball. The shock to the senses is violent and jarring. To be sure, we are all familiar with the crack of the baseball bat when a homer is struck in the ball park.

Bat makers of hollow, metallic bats added a spongy material to the hollow interior as a means to dampen vibration and noise. Other manufacturers filled the interior of the hollow bats with foam material for the same purpose. But the foam or spongy material had low resilience so when deformed, there was minor spring back or slow recovery for the material to re-assume its initial shape. Hence, the conventional method of using sponges or foam damped vibrations or sound to some extent, but the rebound performance of the bat did not improve. Thus, the overall performance and playability of the bat did not greatly improve.

Another attempt at damping the vibration and sound of the bat during impact was through adding a highly viscous liquid such as oil and shotgun shot into the hollow bat. The metal shot and oil were encased in an area below the tapered part of the bat at the handle portion. This modification had practical problems including oil leaks.

SUMMARY OF THE INVENTION

Therefore, in view of the foregoing, it is an object of the present invention to provide a ball bat that incorporates a damped core that suppresses vibration and noise, and simultaneous improves the rebound of the bat after it impacts the ball. It is another object of the present invention to provide a bat that has an improved sweet spot that provides a lively rebound. It is still another object of the present invention to provide a damped core that does not affect the overall weight or swing inertia of the bat. It is yet another object of the present invention to provide a damped core that can be incorporated into a hollow bat made from any material.

To achieve the foregoing objects, the present invention provides a method and apparatus for a damped core ball bat comprising a hollow tube having a tube wall including a barrel portion, a tapered portion and a handle portion. The damped core ball bat includes an inner damper that is covered by a resilient attenuator sleeve. The inner damper is inserted into the hollow tube such that the resilient attenuator sleeve is compressed between the inner damper and the tube wall. After formation of the overall bat shape, by swaging the tapered portion to transition down into a smaller diameter for the handle portion, the damped core can be installed into the bat. A cap covers the open top of the tube and a knob is installed to the open bottom.

In a preferred embodiment, the tube wall of the bat is thinner than in conventional bats. Further, the resilient attenuator sleeve is fairly tough and exhibits tremendous spring back, especially in view of the degree of compression between the inner damper and the tube wall when the former is inserted into the barrel portion of the bat during assembly. Indeed, the resilient attenuator sleeve is often compressed so that its volume has been reduced 50 to 70 percent of the original, relaxed state volume.

Because of the thinner wall of the present invention damped core bat, the deformation in the barrel portion wall caused by impact with the ball is transferred to the resilient attenuator sleeve immediately thereunder. Because the resilient attenuator sleeve is very tough and has high spring back, the kinetic energy from the impact of the ball is conserved and then returned to the ball, giving the bat great rebound action.

The present invention also provides a method of fabricating a damped core bat comprising the steps of forming a tube having an opening, providing a tubular inner damper, covering the tubular inner damper in a resilient attenuator sleeve, inserting the tubular inner damper and the resilient attenuator sleeve into the tube through the opening, expanding the tubular inner damper radially to compress the resilient attenuator sleeve between the tubular inner damper and the tube wall, and enclosing the opening in the tube. Optionally, the bat may be swaged to create a taper and to form a smaller diameter handle portion for easy gripping by the player.

The present invention also provides a method for fabricating a damped core bat comprising the steps of forming a tube having an opening, providing an inner damper, covering the inner damper in a resilient attenuator sleeve, compressing the resilient attenuator sleeve, inserting the compressed resilient attenuator sleeve and inner damper through the opening into the tube, and enclosing the opening. In one preferred embodiment, the method uses a funnel-like apparatus to compress the resilient attenuator sleeve to obtain a smaller diameter which can then be forced into the hollow interior of the tube that forms the bat. Once the resilient attenuator sleeve and inner damper have slid into the hollow tube, the funnel-like apparatus can be removed and the opening covered with an end cap.

Any vacant spaces inside the bat can optionally be filled with foam or sponge as in conventional bats. In the preferred embodiment, the resilient attenuator sleeve is made from a polystyrene closed cell foam. Preferably, the inner damper is made into a hollow tube formed from brass, aluminum, or a like malleable yet lightweight material. The tube material for the bat can be of any material known in the art including aircraft or aerospace grade aluminum alloys. Preferably, the wall at the barrel portion in the preferred embodiment ranges between 0.070 to 0.080 inch.

BRIEF DESCRIPTION OF THE DRAWINGS

The objects, features and advantages of the present invention will be apparent to one skilled in the art from reading the following detailed description in which:

FIG. 2 provides a perspective view of the preferred methods of fabricating the present invention damped core bat wherein:

FIG. 2(*a*) is a perspective view of the raw tubing used to form the bat;

FIG. 2(*b*) shows the tubing after the swaging operation;

FIG. 2(*c*) shows the tubular inner damper prior to assembly with the resilient attenuator sleeve;

FIG. 2(*d*) shows the inner damper after being covered by the resilient attenuator sleeve just prior to insertion into the tube;

FIG. 2(*e*) shows a step of compressing the resilient attenuator sleeve prior to insertion in the tube;

FIG. 2(*f*) shows an alternative embodiment step wherein the resilient attenuator sleeve and inner damper combination are inserted into the hollow tube and a tube expander is inserted therein for radial expansion of the inner damper.

DETAILED DESCRIPTION OF THE INVENTION

The following specification describes a method and apparatus for a damped core ball bat. In the description, specific materials and configurations are set forth in order to provide a more complete understanding of the present invention. It is understood, however, that the present invention can be practiced without those specific details. In some instances, well-known elements are not described in more detail so as not to obscure certain aspects of the present invention.

The present invention is directed to a damped core ball bat. Generally, the invention is directed to hollow bats that are fabricated from tubing with a deformable but resilient wall. On the other hand, the present invention contemplates bats of various diameters, lengths, cross-sectional shapes, weights, for use in a variety of sporting applications from softball to hardball to baseball to T-ball, etc.

Figure 3:
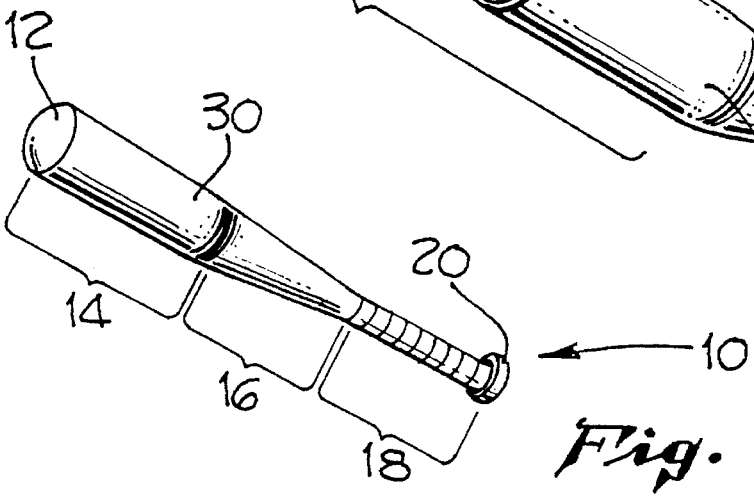
FIG. 3 is a perspective view of the present invention bat in the finished product stage.

FIG. 3 is a perspective of a preferred embodiment of the present invention damped core bat. The bat 10 has several basic parts including an end cap 12, a barrel portion 14, a tapered portion 16, a handle portion 18, and a knob 20. Optionally, the handle portion 18 can be covered by rubber or leather grip tape 22. The general exterior shape and configuration of a baseball bat are well-known in the art.

Figure 1A:
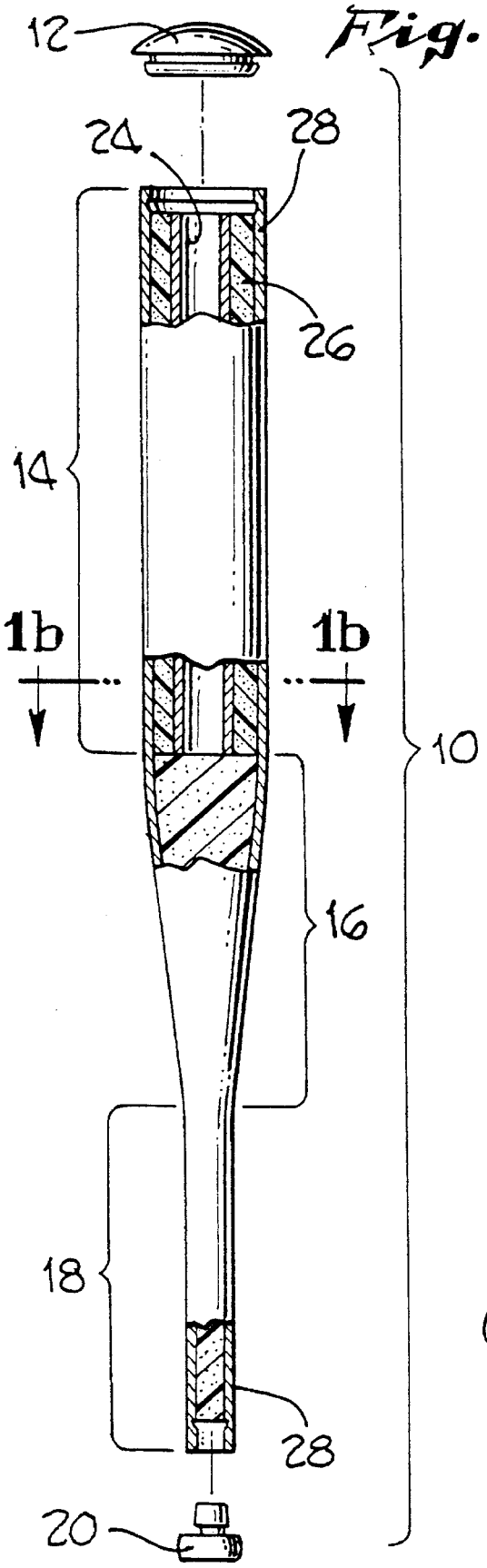
FIG. 1 provides sectional views of a preferred embodiment damped core bat, wherein FIG. 1(*a*) shows a lengthwise cross-sectional view of the bat with the end cap and knob dissembled therefrom; and wherein FIG. 1(*b*) shows a cross-sectional view of the bat taken along line 1—1 of FIG. 1(*a*).
Figure 1B:
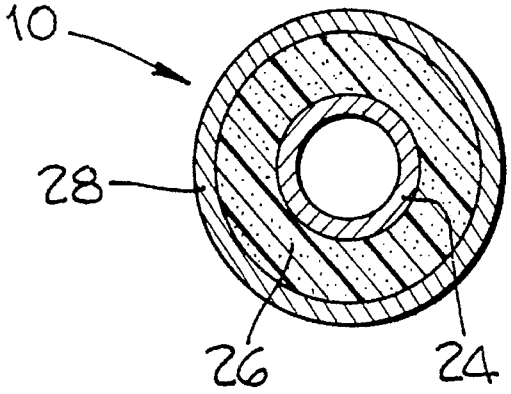
Figure 2A:
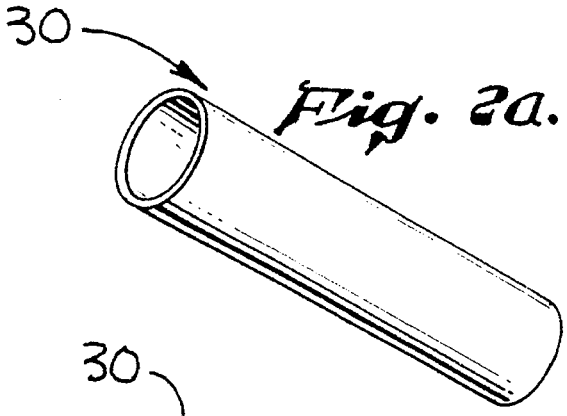
Figure 2B:
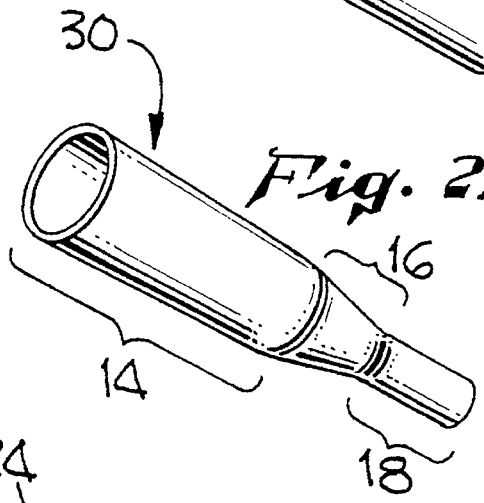
Figure 2C:
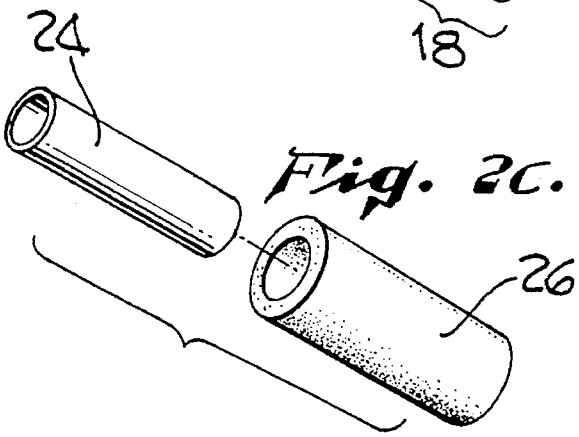
Figure 2D:
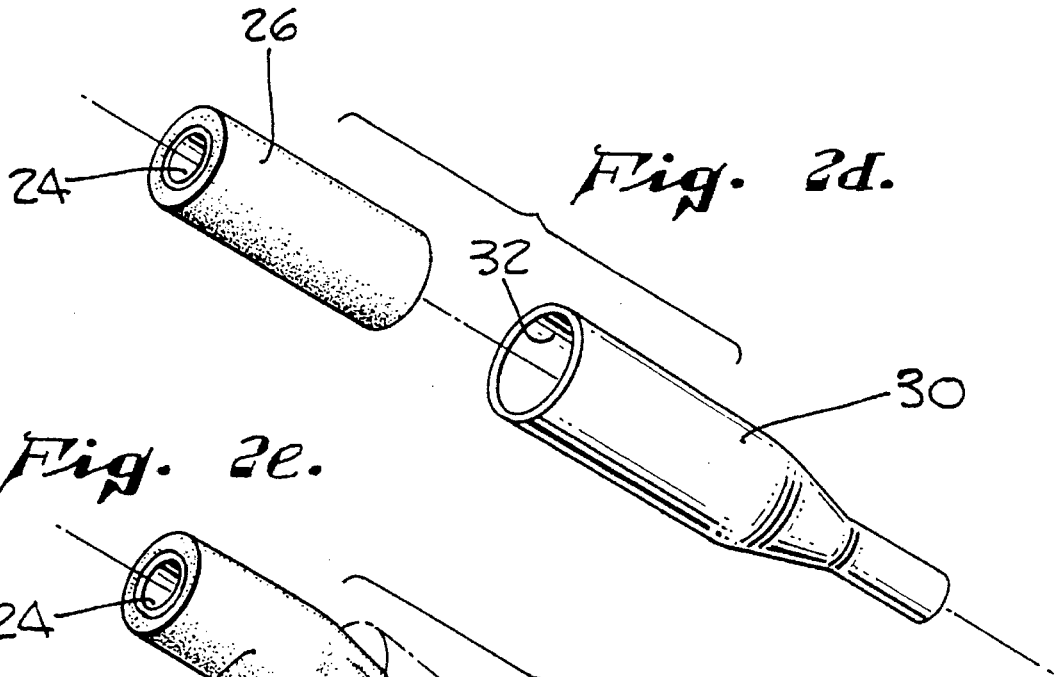
Figure 2E:
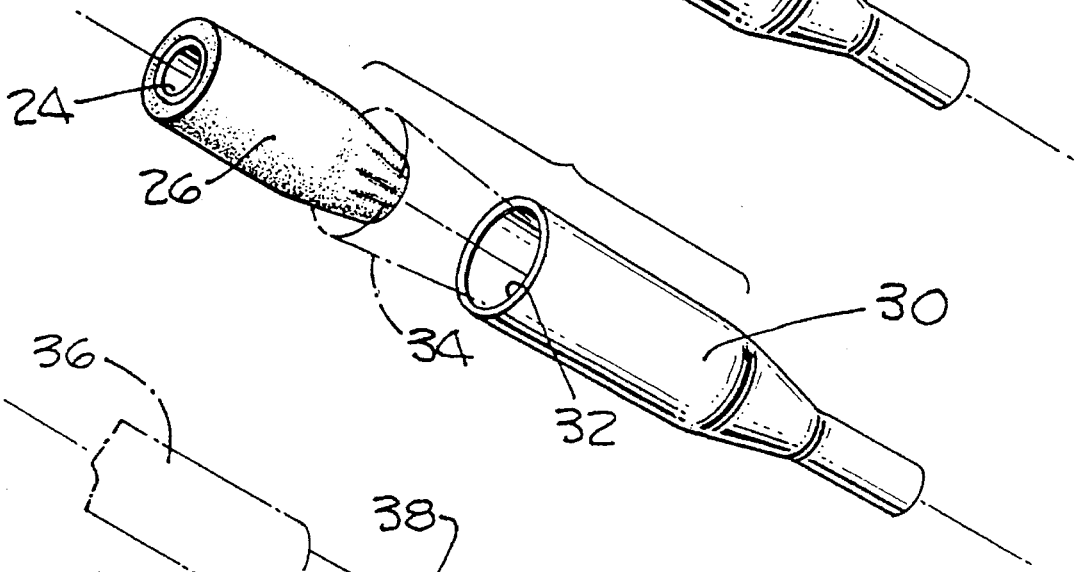
Figure 2F:
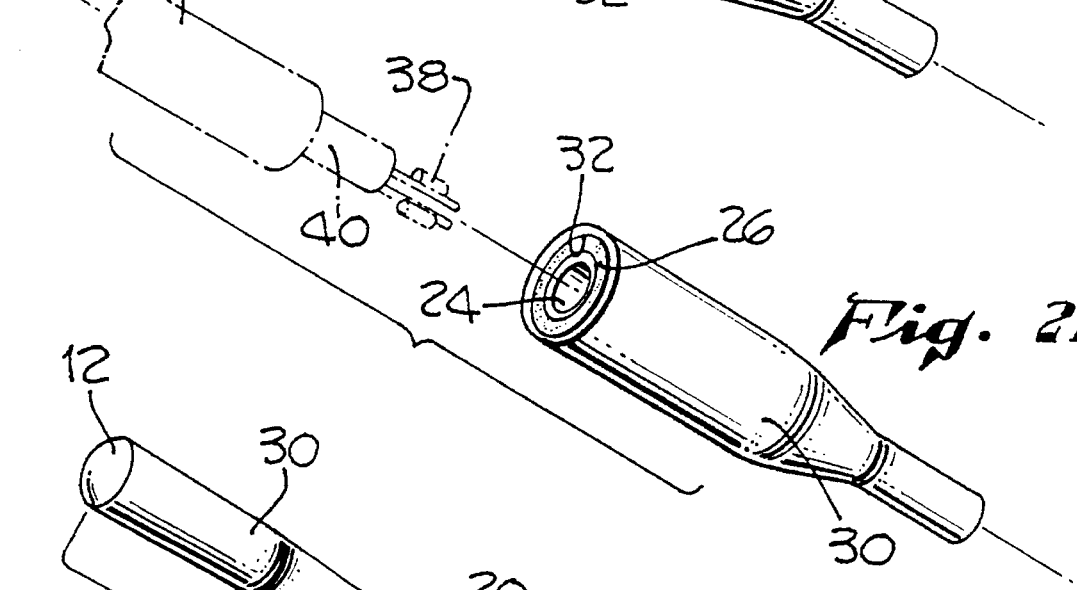

FIG. 1(*a*) provides a better understanding of the present invention. In particular, FIG. 1(*a*) is a cross-sectional view of a damped core bat taken along the length of the bat 10 shown in FIG. 3. As seen in FIG. 1(*a*), the present invention is directed to hollow interior ball bats. The bat 10 in the sectional view is again separated into three discrete portions including the barrel portion 14, the tapered portion 16, and the handle portion 18.

In the embodiment shown in FIG. 1(*a*), the end cap 12 and knob 20 have been disassembled from the main body for clarity of illustration. The end cap 12 and knob 20 snap into place by use of a ridge and groove combination shown in FIG. 1(*a*). Naturally, other mechanisms known in the art such as bonding or screw threads can be used to secure the end cap 12 or the knob 20 to the main body of the bat 10.

The present invention damped core bat 10 includes a core that dampens vibrations and noise as well as providing a "sweet spot" to improve the rebound action of the bat. This is accomplished by inserting a resilient core into the barrel portion 14 of the bat, where most of the ball impacts occur. The resilient material of the core absorbs the high frequency shock waves generated by impact of the bat with the ball. Moreover, spring back in the resilient material improves the rebound effect in the bat wall thereby returning most of the kinetic energy back to the ball just before it bounces off of the impact area.

In the preferred embodiment shown in FIG. 1(*a*), the damped core comprises an inner damper 24 having a tubular shape. FIG. 1(*b*) provides a cross-section view of the damped core bat 10 taken along line 1—1 of FIG. 1(*a*). In this figure, it is plain to see that the bat 10 embodies the popular cylindrical shape of the most popular bats; necessarily, the inner damper 24 is also of a circular shape. Immediately surrounding the inner damper 24 is a resilient attenuator sleeve 26. Together, the resilient attenuator sleeve 26 disposed over the inner damper 24 form the damped core of the bat 10.

In the preferred embodiment shown in FIG. 1, the inner damper 24 and resilient attenuator sleeve 26 are inserted into the barrel portion 14 of the bat 10 and preferably coincide with the length of the barrel portion 14. Importantly, the resilient attenuator sleeve 26 is compressed, through processes discussed below, between the inner damper 24 and the inside diameter of the tube wall 28 that forms the bat 10.

The inner damper 24 is preferably made from a rigid material that does not collapse as the resilient attenuator sleeve 26 is compressed. Thus, just beneath the wall 28 resides the resilient attenuator sleeve 26 which by its nature has great spring back and, after assembly compression, has even higher spring back. Accordingly, when the ball impacts the bat, the deformation in the wall 28 therefrom is absorbed by the resilient attenuator sleeve 26 with the rigid inner damper 24 providing the underlying support in the impact area of the bat.

As mentioned earlier, the resilient attenuator sleeve 26 is under great compression. Indeed, the resilient attenuator sleeve 26 is compressed to reduce 50 to 70 percent of its initial relaxed state volume. As a result, the tight fit maintains the position of the inner damper 24 relative to the length of the bat 10. Furthermore, because the inner damper 24 is essentially suspended or free floating at the center core of the bat 10, shock waves from a ball impact propagate through the resilient attenuator sleeve 26 to the inner damper 24, which vibrates at certain resonant frequencies. To be sure, empirical tests show that varying the dimensions of the inner damper 24 affects the resonant frequencies of the bat 10, and accordingly, the sound and vibration damping capability of the bat. The processes to obtain the proper damper weight and proportions in such a vibration system are well-known in the art and need not be discussed further here.

In general, the present invention is directed to metallic bats wherein the wall 28 is made from a metal such as aluminum alloy. The material must flex, yet exhibit fast spring back rates. In the preferred embodiments, the present invention uses an aircraft grade aluminum alloy known in the market as 7046HT; another metallic alloy commonly found in the aerospace industry known as CU31 can also be used as the tube material to form the bat. The aerospace alloy CU31 and the aircraft alloy 7046HT are high strength, good durability, lightweight materials. Those materials further permit the wall 28 to be fabricated thinner than conventional bats. For instance, alloy bats typically have a barrel portion wall thickness of 0.075 inch, while economy aluminum baseball bats have barrel portion wall thicknesses ranging from 0.097 to 0.150 inch. The present invention preferably has a thin-wall dimension ranging between 0.070 to 0.080 inch.

The thin wall insures that there is sufficient deflection in the wall 28 during impact with the ball to compress the resilient attenuator sleeve 26 directly beneath. The kinetic energy is then absorbed by the wall 28 and the resilient attenuator sleeve 26, then returned to the ball during spring back to effect a lively rebound. Therefore, the liveliness of the bat is most apparent in the barrel portion, giving the bat a large sweet spot.

In the preferred embodiment, the resilient attenuator sleeve 26 is made from polystyrene closed cell foam. In an alternative embodiment, the sleeve can be made from a urethane. Of course, other polymers and elastomers exhibiting sufficient toughness and fast spring back rates known in the art can be used. Needless to say, the resilient attenuator sleeve 26 should thus have a high Young's modulus of elasticity.

Preferably, the inner damper 24 is made of a rigid yet malleable material such as brass. The material should be lightweight so as not to affect the swing inertia of the bat. In fact, the inner damper 24 can be made from materials such as aluminum, brass, plastic, rubber, wood, paper, or fiberglass. Optionally, the interior of the bat 10 aside from the damping core can be filled with a spongy material 42 or foam known in the art to further dampen the vibrations and to quell any offending sounds generated during the ball impact.

The profile of the bat shown in FIG. 1(*a*) is merely for illustration. One skilled in the art can easily modify the profile in order to obtain selected bend points of the bat to achieve particular performance goals.

FIGS. 2(*a*)–2(*f*) illustrate the processes involved in fabricating the present invention damped core bat. FIG. 2(*a*) is a perspective view of the initial raw material that is used for the present invention bat. Specifically, a simple tube 30 is selected during the initial step of the present invention process. As mentioned above, the tube 30 is preferably made of a high tensile aluminum alloy or high strength aircraft alloy. Other raw materials for bats known in the art can be used, including titanium and magnesium. It is possible to use even composites or ceramic materials for the tube 30.

FIG. 2(*b*) shows the tube 30 after a swaging operation that creates a tapered portion 16 and a ,handle portion 18. The unworked area of the tube 30 becomes the barrel portion 14. This step is necessary insofar as the bat must have a gripping area provided by the handle portion 18. If the material is a ceramic or composite, other processes known in the art can be employed to neck down the tubing in the areas as shown to produce the tapered portion and handle portion.

FIG. 2(*c*) is a perspective view of the inner damper 24 prior to its assembly to the resilient attenuator sleeve 26. No bonding agent between the two parts is needed because the resilient attenuator sleeve 26 is compressed when in the finished state, and is held in place by a friction fit.

FIG. 2(*d*) shows the inner damper 24 and resilient attenuator sleeve 26 combination just prior to insertion into the top opening 32 of the tube 30. Notably, the outside diameter of the resilient attenuator sleeve 26 in its relaxed state is larger than the inside diameter of the tube 30 and top opening 32.

Thus, in FIG. 2(*e*), a funnel-like apparatus 34 is used to pre-compress the resilient attenuator sleeve 26 to facilitate insertion of the sleeve and damper combination into the tube 30. In effect, the funnel-like apparatus 34 is an outer sleeve that simultaneously compresses the resilient attenuator sleeve 26 into a smaller diameter and assists in sliding the damper-sleeve combination into the intended position inside the tube 30. There are many mechanisms known in the art to accomplish the task performed by the funnel-like device 34 and can be used here as well.

FIG. 2(*f*) shows an alternative embodiment method to the insertion of the sleeve-damper combination into the tube 30. Specifically, the tube and sleeve combination shown in FIG. 2(*c*) is made to an appropriate outside diameter dimension such that the combination can be inserted into the opening 32 of the tube 30 without pre-compression or use of force. Once installed therein, a tube expander 36 or similar equipment known in the art is inserted into the interior of the inner damper 24 so that its inside diameter can be expanded radially. By expanding the inside diameter of the inner damper 24, the resilient attenuator sleeve 26 is accordingly compressed between it and the tubing wall.

In the embodiment shown in FIG. 2(*f*), the tube expander 36 has a probe 40 with rollers 38 that can simultaneously rotate and spread radially so that once the probe and rollers are inserted inside the inner damper 24, the rollers 28 engage the inside diameter of the inner damper 24 and force the material outward. Hence, brass if selected as the inner damper material is quite suitable for this type of cold working operation, and subsequently maintains its shape after the operation.

What is claimed is:

1. A damped core bat comprising:

a cylinder having a cavity therein bounded by cavity walls, the cylinder including a barrel portion, a tapered portion and a handle portion;

a free floating tubular shape inner damper;

a resilient attenuator sleeve disposed over the inner damper;

wherein the free floating inner damper is disposed inside the cavity without contacting the cavity walls and the resilient attenuator sleeve is compressed between the inner damper and the cavity walls.

2. The damped core bat according to claim 1, wherein the inner damper further comprises a malleable material.

3. The damped core bat according to claim 2, wherein the inner damper extends substantially along an entire length of the barrel portion.

4. The damped core bat according to claim 3, wherein the resilient attenuator sleeve further comprises a high recovery rate.

5. The damped core bat according to claim 4, wherein the resilient attenuator sleeve further comprises a high Young's modulus of elasticity.

6. A damped core ball bat comprising:

a tube having a top opening, a bottom opening, and a tube wall forming a barrel portion, a tapered portion, and a handle portion having a diameter smaller than a diameter of the barrel portion;

a cap covering the top opening;

a rigid inner damper having a tubular shape with a hollow interior, wherein the inner damper is not attached to the cap;

a resilient attenuator sleeve disposed over the rigid inner damper, wherein the rigid inner damper is disposed inside the barrel portion and the resilient attenuator sleeve is compressed between the rigid inner damper and the tube wall; and a knob covering the bottom opening.

7. The damped core ball bat of claim 6, wherein the tube further comprises an aluminum alloy.

8. The damped core ball bat of claim 8, wherein tube further comprises low density foam disposed therein.

9. A method for fabricating a damped core bat comprising the steps of:

forming a tube having an opening;

providing a tubular inner damper;

covering the tubular inner damper in a resilient attenuator sleeve;

inserting the tubular inner damper and the resilient attenuator sleeve into the tube;

expanding the tubular inner damper radially;

compressing the resilient attenuator sleeve between the expanded tubular inner damper and the tube; and enclosing the opening.

10. The method for fabricating a damped core bat according to claim 9, wherein the step of compressing the resilient attenuator sleeve reduces the volume of the resilient attenuator sleeve approximately 50 to 70 percent.

11. The method for fabricating a damped core bat according to claim 10, wherein the step of covering the opening further comprises the steps of attaching a cap to an end of the tube and attaching a knob to another end of the tube.

12. The method for fabricating a damped core bat according to claim 11, wherein the method further comprises the step of swaging the tube to form a taper and a handle portion having a diameter smaller than a diameter of the tube.

13. The method for fabricating a damped core bat according to claim 12, wherein the method further comprises the step of filling the tube with a foam material.

14. A method of fabricating a damped core, ball bat comprising the steps of:

forming a tube having an opening;

providing a damped core having a free floating inner damper;

inserting the damped core through the opening into the tube so that the inner damper is suspended therein and does not contact the tube; and enclosing the opening.

15. The method according to claim 14, wherein the tube includes a tube diameter and the damped core includes a core diameter and wherein the core diameter is greater than the tube diameter, and the step of inserting the damped core into the tube creates a tight fit between the damped core and the tube.

* * * * *